US007763818B2

(12) United States Patent
Lusk et al.

(10) Patent No.: US 7,763,818 B2
(45) Date of Patent: Jul. 27, 2010

(54) SPHERICAL BISTABLE MECHANISM

(75) Inventors: Craig Lusk, Lutz, FL (US); Larry L. Howell, Orem, UT (US)

(73) Assignee: Brigham Young University, Provo, UT (US)

( * ) Notice: Subject to any disclaimer, the term of this patent is extended or adjusted under 35 U.S.C. 154(b) by 931 days.

(21) Appl. No.: 11/496,747

(22) Filed: Jul. 31, 2006

(65) Prior Publication Data

US 2007/0023271 A1 Feb. 1, 2007

Related U.S. Application Data

(60) Provisional application No. 60/704,069, filed on Jul. 29, 2005.

(51) Int. Cl.
*H01H 13/14* (2006.01)
*H01H 3/12* (2006.01)

(52) U.S. Cl. ..... 200/341

(58) Field of Classification Search ..... 200/341
See application file for complete search history.

(56) References Cited

U.S. PATENT DOCUMENTS

| | | | | |
|---|---|---|---|---|
| 3,272,936 | A * | 9/1966 | Potter | 200/61.39 |
| 6,215,081 | B1 | 4/2001 | Jensen et al. | |
| 6,757,975 | B1 * | 7/2004 | Todd et al. | 29/893.33 |
| 7,342,472 | B2 * | 3/2008 | Charvet | 335/78 |

* cited by examiner

*Primary Examiner*—Michael A Friedhofer
*Assistant Examiner*—Lheiren Mae A Caroc
(74) *Attorney, Agent, or Firm*—Steven L. Nichols; Vancott, Bagley, Cornwell & McCarthy PC

(57) ABSTRACT

A spherical bi-stable mechanism includes a planar bi-stable compliant member including an input and an output, and a spherical mechanism member coupled to the output of the first planar bi-stable compliant component. An actuation of the first planar bi-stable compliant member in a first plane is configured to cause the spherical mechanism member to be selectively positioned in a second plane.

22 Claims, 11 Drawing Sheets

SPHERICAL BISTABLE MECHANISM

RELATED APPLICATION

The present application claims priority under 35 U.S.C. §119(e) of previous U.S. Provisional Patent Application No. 60/704,069, filed Jul. 29, 2005, entitled "Spherical bistable mechanism," which application is incorporated herein by reference in its entirety.

TECHNICAL FIELD

The present systems and methods relate to dual position mechanisms. More particularly, the present systems and methods relate to bi-stable mechanisms and apparatuses that can be manufactured in a plane, but can provide large out of plane motion.

BACKGROUND

The term "compliant mechanisms" relates to a family of devices in which integrally formed flexural members provide motion through deflection. Such flexural members may therefore be used to replace conventional multi-part elements such as pin joints. Compliant mechanisms provide several benefits, including backlash-free, wear-free, and friction-free operation. Moreover, compliant mechanisms significantly reduce manufacturing time and cost. Compliant mechanisms can replace many conventional devices to improve functional characteristics and decrease manufacturing costs. Assembly may, in some cases, be obviated entirely because compliant structures often consist of a single piece of material.

In microelectromechanical systems (MEMS), compliant technology allows each mechanism of a MEMS system to be an integrally formed, single piece mechanism. Because MEMS devices are typically made by a layering and etching process, elements in different layers must normally be etched and formed separately from each other. Additionally, elements with complex shapes, such as pin joints, require multiple steps and layers to create the pin, the head, the pin-mounting joint, and the gap between the pin and the surrounding ring used to form the joint. While pin joints do have difficulties in manufacturing, these complex shapes do have advantages of allowing large displacements and low stresses compared to fully compliant mechanisms.

An integrally formed compliant mechanism, on the other hand, may be constructed as a single piece, and may even be constructed in unitary fashion with other elements of the micromechanism. Substantially all elements of many compliant devices may be made from a single layer. Reducing the number of layers, in many cases, simplifies the manufacturing and design of MEMS devices. Compliant technology also has unique advantages in MEMS applications because compliant mechanisms can be manufactured unitarily, i.e., from a single continuous piece of material, using masking and etching procedures similar to those used to form semiconductors.

In MEMS as well as in other applications, there exists a large need for "bi-stable devices," or devices that can be selectively disposed in either of two different, stable configurations. Bistable devices can be used in a number of different mechanisms, including switches, valves, clasps, and closures. Switches, for example, often have two separate states: on and off. However, most conventional switches are constructed of rigid elements that are connected by hinges, and therefore do not obtain the benefits of compliant technology. Compliant bi-stable mechanisms have particular utility in a MEMS environment, in which electrical and/or mechanical switching at a microscopic level is desirable, and in which conventional methods used to assemble rigid body structures are ineffective.

Bistable mechanisms present a unique challenge because the compliant elements must be properly balanced so that two fully stable positions exist. Even if a bi-stable design is obtained by fortunate guesswork or extensive testing, conventional optimization techniques are often ineffective because the design space is so complex, i.e., highly nonlinear and discontinuous, with such a small feasible space that gradient-driven methods are unable to reach a workable solution. The likelihood that a stochastic method will stumble onto a solution is extremely small in fully compliant designs. Hence, it is difficult to enhance the fully compliant bi-stable designs, except through additional experimentation.

However, implementation of designs that allow for large displacements of bi-stable mechanisms can provide for mechanisms that are more predictable and require less experimentation to obtain two stable configurations. Adding pin joints to compliant mechanisms can allow for these large displacements to enable bistability without undue experimentation and analysis. Unfortunately, previous MEMS bi-stable designs have encountered difficulties with applying pin joints to non-stationary members. Additionally, various attempts of using non-stationary pin joints have encountered motion problems as the result of stiction, the bonding of moveable members to the microchip substrate.

Further, there is a need for accurate, low power mechanisms for the out-of-plane positioning of microelectromechanical system (MEMS). Such mechanisms are useful in mirror arrays and in erectable structures. One possible means of achieving these accurate, low power mechanisms is to develop out-of-plane bi-stable mechanisms. Several different design concepts for bi-stable mechanisms have been identified including mechanisms composed of rigid and compliant links, bucking structures, and braking or latching devices. Buckling and latching devices have also been used to position out-of-plane mechanisms.

However, out-of-plane compliant bi-stable mechanisms are somewhat challenging because the devices are fabricated in-plane and the elasticity of the compliant segments tends to cause them to return to the plane of fabrication.

SUMMARY

In one of many possible embodiments, the present exemplary system provides a spherical bi-stable mechanism including a planar bi-stable compliant member including an input and an output, and a spherical mechanism member coupled to the output of the first planar bi-stable compliant component. An actuation of the first planar bi-stable compliant member in a first plane is configured to cause the spherical mechanism member to be selectively positioned in a second plane.

Additionally, according to one exemplary embodiment a method of designing a microelectromechanical system (MEMS) spherical bistable mechanism that includes a four bar planar bistable compliant member and a spherical mechanism member includes performing a position analysis of four bar planar bistable compliant member using a Pseudo-Rigid-Body Model (PRBM) approximation, and executing a position analysis of the spherical bi-stable mechanism using spherical geometry and a position input from the position analysis of the four bar planar bistable compliant member.

BRIEF DESCRIPTION OF THE DRAWINGS

The accompanying drawings illustrate various embodiments of the present exemplary system and method and are a part of the specification. The illustrated embodiments are merely examples of the present exemplary system and method and do not limit the scope thereof.

Throughout the drawings, identical reference numbers designate similar, but not necessarily identical, elements.

DETAILED DESCRIPTION

The present exemplary systems and methods provide for low power mechanism configured to produce out-of-plane positioning. In particular, an exemplary out-of-plane positioning microelectromechanical system (MEMS) may include a first planar bi-stable compliant component and a spherical mechanism portion configured to convert linear in-plane motion provided by the first planar bi-stable compliant component to out-of-plane motion. Further details of the present exemplary systems and methods will be described in further detail below.

The present descriptions and exemplary systems are described in terms of an exemplary microelectromechanical system (MEMS) to detail the formation and structure of the system, and for ease of explanation. However, describing the present exemplary systems and methods in terms of a MEMS structure in no way limits the scope of the claims to only a MEMS structure. Rather, the present exemplary systems and methods may similarly be applied to macro systems.

As used in the present specification, and in the appended claims, the term "compliant mechanism" is meant to be understood as a device in which one or more integrally formed flexural members provide motion through deflection.

In the following description, for purposes of explanation, numerous specific details are set forth in order to provide a thorough understanding of the present systems and methods for producing a low power mechanism configured to produce out-of-plane positioning. It will be apparent, however, to one skilled in the art that the present systems and methods may be practiced without these specific details. Reference in the specification to "one embodiment" or "an embodiment" means that a particular feature, structure, or characteristic described in connection with the embodiment is included in at least one embodiment. The appearance of the phrase "in one embodiment" in various places in the specification are not necessarily all referring to the same embodiment.

Exemplary Structure

Figure 1:
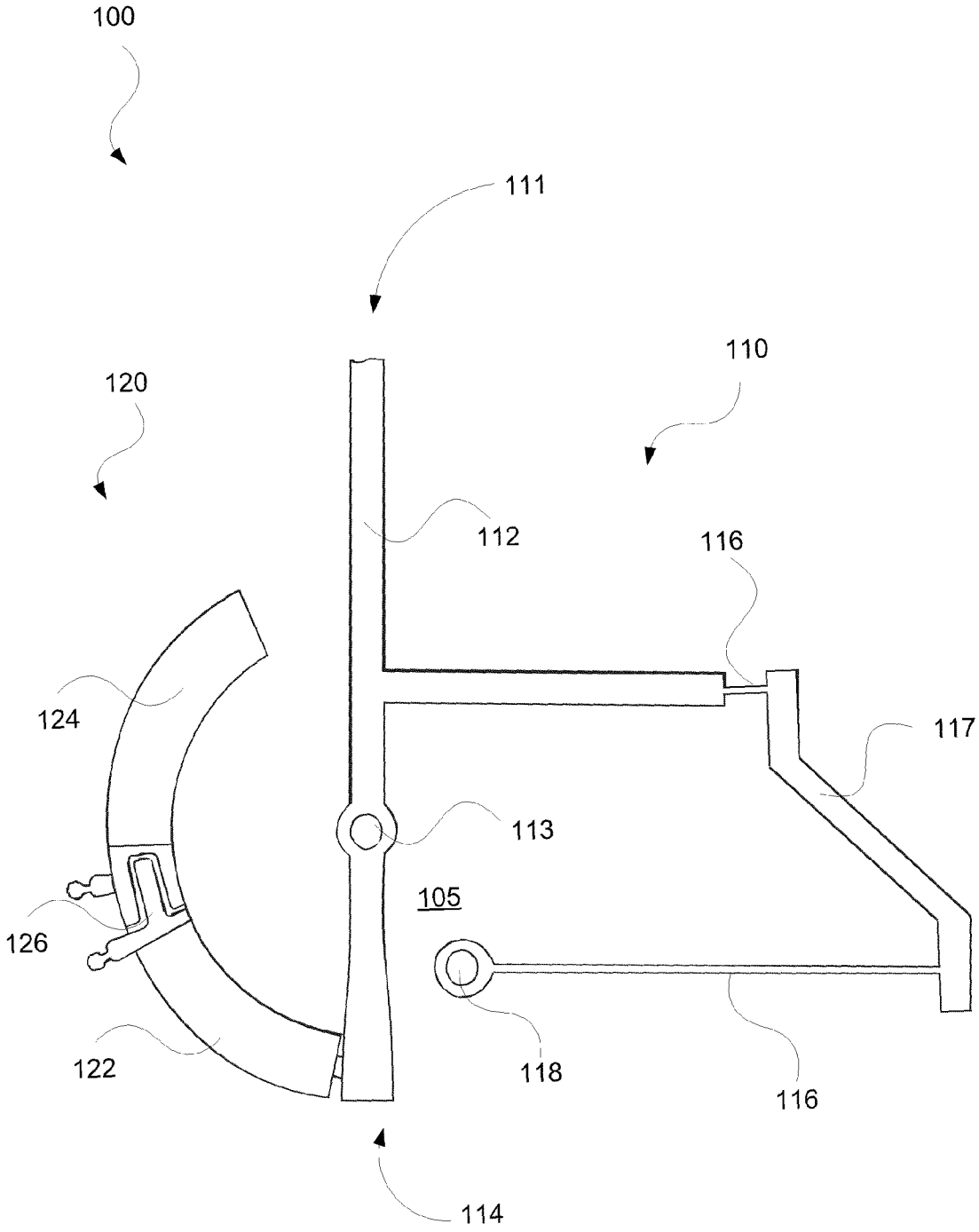
FIG. 1 illustrates a top view of a spherical bi-stable mechanism in a first stable equilibrium position, according to one exemplary embodiment.
Figure 2:
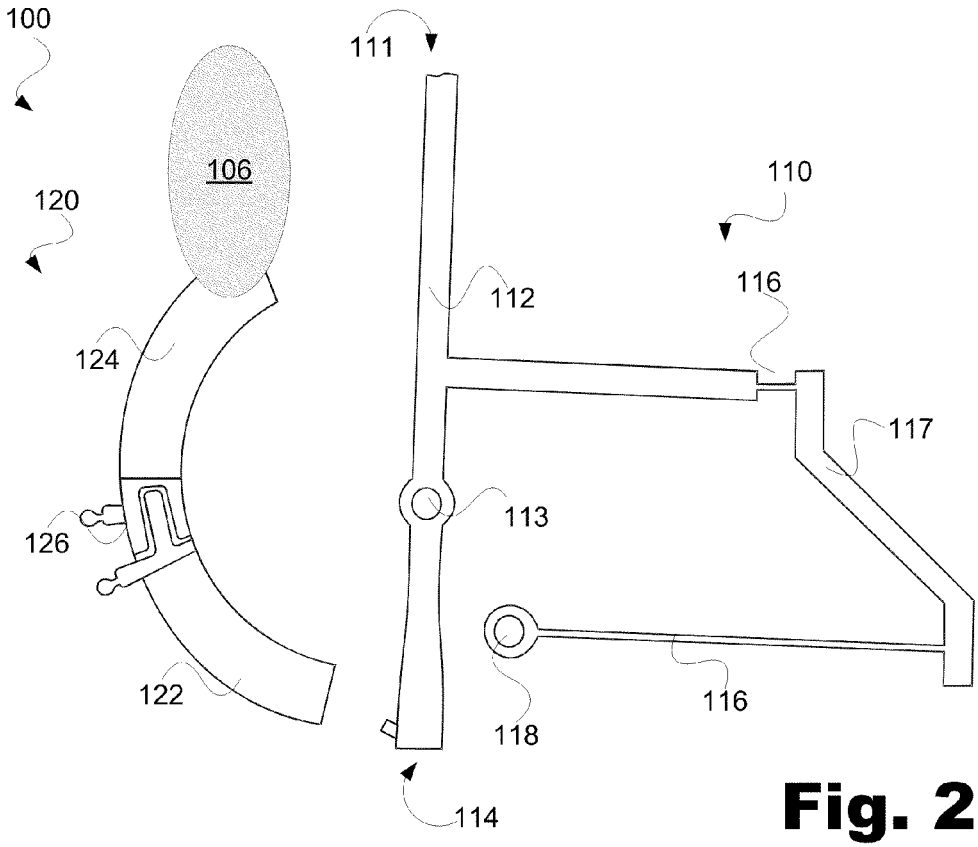
FIG. 2 illustrates a separated image of a spherical bi-stable mechanism in a first stable equilibrium position, physically separating a bistable component from a spherical mechanism component, according to one exemplary embodiment.

FIGS. 1 and 2 illustrate, respectively, a general structure and a separated structure of a spherical bi-stable mechanism (100), according to one exemplary embodiment. As illustrated in FIG. 1, the spherical bi-stable mechanism (100) includes a first planar bi-stable compliant component (110) and a spherical mechanism portion (120). As will be detailed further below, present exemplary spherical bi-stable mechanism (100) combines two recent advances in MEMS design in a unique way to provide a device that achieves bi-stable out-of-plane positioning through the use of compliant mechanisms.

Continuing with FIGS. 1 and 2, the first planar bi-stable compliant component (110) may include any input receiving mechanism configured to be selectively disposed in either of two different, stable configurations, based on an input force. According to the exemplary embodiment illustrated in FIGS. 1 and 2, the bi-stable compliant component (110) includes an input member (112) rotatably coupled to a substrate (105) at an intermediate pin location (113). According to one exemplary embodiment, the input member (112) includes a force receiving end (the input) (111) and a motion transmitting end (the output) (114). The force receiving end (111) may be associated with an actuator (not shown) configured to provide sufficient force to the force receiving end of the input member (112) to transition the bi-stable compliant component (110) between a first and a second stable configuration.

In addition to the intermediate pin location (113), the bi-stable compliant component (110) is rotatably coupled to the substrate at a second pin location (118). A plurality of compliant segments (116) and a rigid segment (117) disposed between the plurality of compliant segments couple the second pin location (118) to the input member (112) and allow for the two stable positions of the bi-stable compliant component (110).

Figure 3:
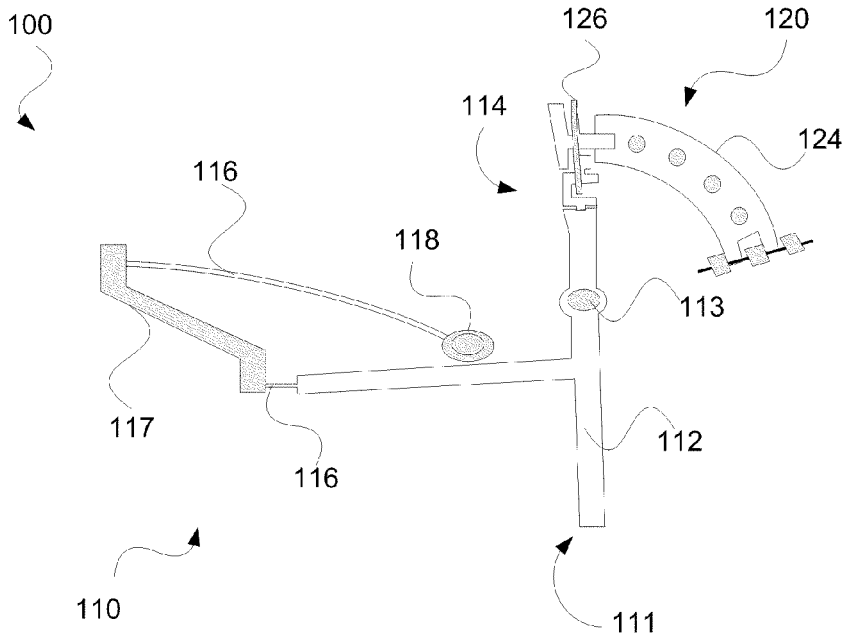
FIG. 3 is a perspective view of a spherical bi-stable mechanism in a second stable equilibrium position, according to one exemplary embodiment.

FIG. 3 is a perspective view illustrating the bi-stable compliant component in a second stable position, according to one exemplary embodiment. As shown in FIG. 3, when a sufficient force is imparted on the input member (112) the force receiving end (111) and the motion transmitting end (114) of the input member (112) rotate about the intermediate pin location (113). Upon rotation of the input member (112) about the intermediate pin location (113), the compliant segments (116) flex and maintain the bi-stable compliant component (110) in the second stable position without additional force input to the input member (112).

The configuration illustrated in FIGS. 1 through 3 demonstrate a planar bi-stable compliant component (110) that is commonly known as the Young Mechanism. The Young Mechanism is detailed in U.S. Pat. No. 6,215,081, which reference is incorporated herein by reference in its entirety. According to one exemplary embodiment of the present exemplary spherical bi-stable mechanism (100), the bi-stable compliant component (110) provides an in-plane input motion configured to actuate the spherical mechanism portion (120) and provide two stable positions for the output of the spherical mechanism portion. Further details of the structure and operation of the spherical mechanism portion (120) of the present exemplary spherical bi-stable mechanism (100) will be provided below.

As illustrated in FIGS. 1 and 2, the spherical mechanism portion (120) of the present exemplary spherical bi-stable mechanism (100) includes a coupler link (122) and an output link (124) coupled by at least one collapsible union (126). Further, as shown in FIGS. 1 and 2, the output link (124) of the spherical mechanism portion (120) is hingedly coupled to the base substrate. Additionally, the coupler link (122) is also rotatably coupled to the motion transmitting end (114) of the input member (112), thereby allowing for the translation and rotation of the spherical mechanism portion configured to produce efficient out-of-plane positioning, according to one exemplary embodiment.

Figure 5:
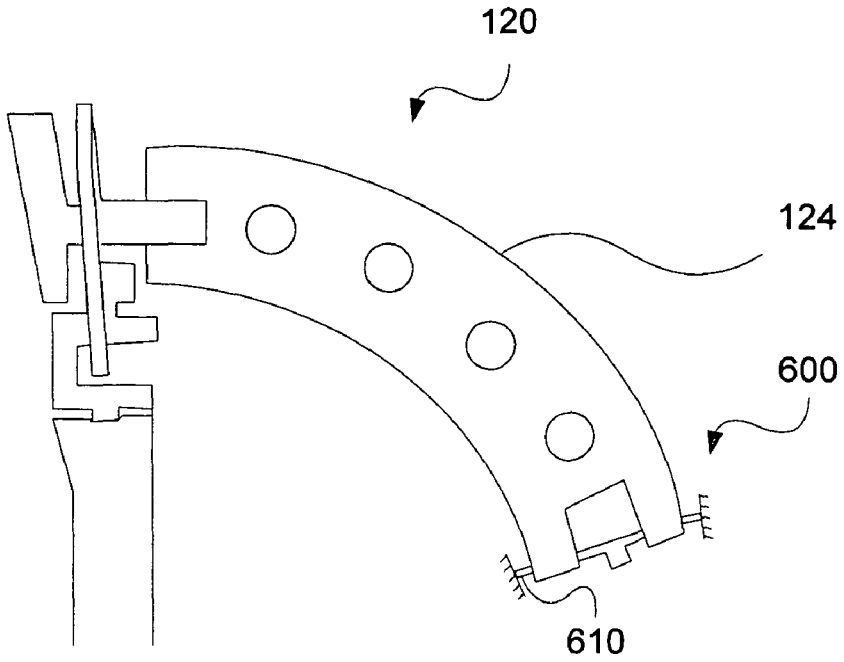
FIG. 5 illustrates a perspective view of a torsion hinge that may form a component of the spherical bi-stable mechanism, according to one exemplary embodiment.

As illustrated, the spherical mechanism portion (120) may include a micro spherical slider-crank configured to transform an in-plane input-rotation provided by the bi-stable compliant component (110) to an out-of-plane output rotation. While the coupler link (122) and the output link (124) are illustrated as being pivotably coupled by a number of collapsible unions (126) and pinned hinges, any number of hinge configurations may be used including, but in no way limited to the compliant torsional hinges (600) illustrated in FIG. 5. According to one exemplary embodiment, the compliant torsional hinges (600) illustrated in FIG. 5 provide for rotation about an axis by allowing for a torsional bending to occur in the thin connecting arms (610).

Figure 4:
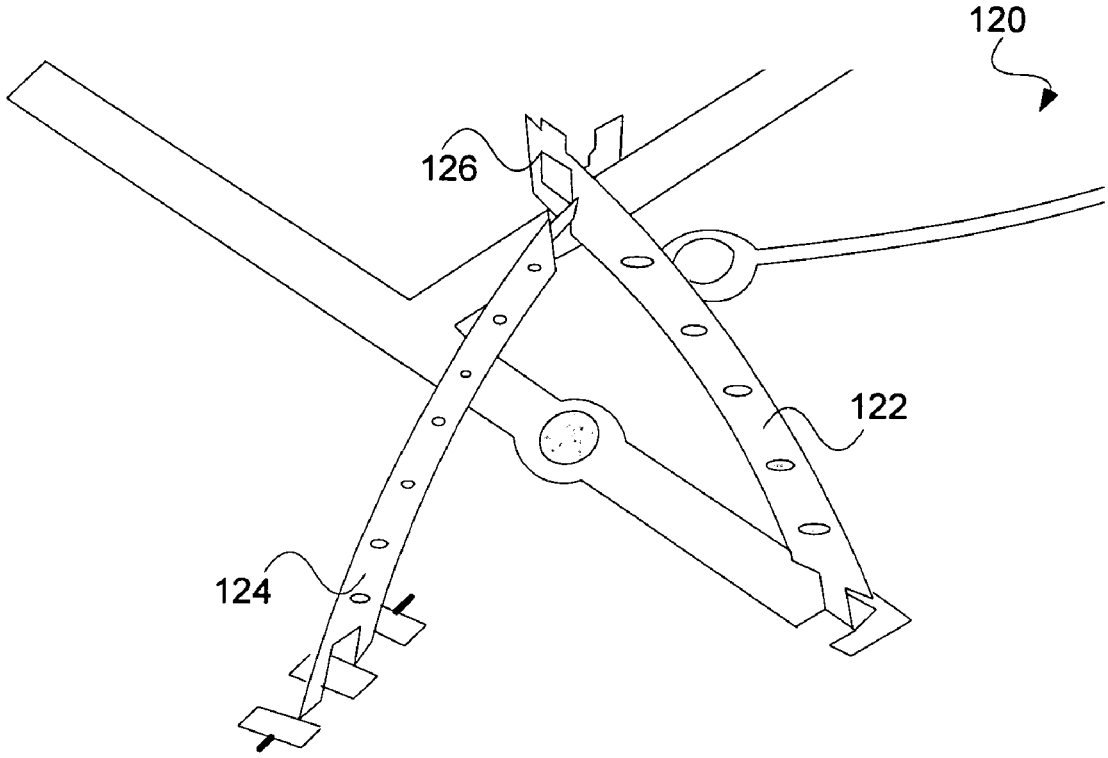
FIG. 4 is a perspective view illustrating a perspective view of a spherical bi-stable mechanism in a second stable equilibrium position, according to one exemplary embodiment.

FIG. 4 illustrates a perspective view of the spherical mechanism portion (120) in an actuated position providing out-of-plane positioning. As shown, when the planar bi-stable compliant component (110) is converted to its second stable position, the motion transmitting end (114) provides an arcuate motion about the intermediate pin location (113). This arcuate motion is transmitted to the coupler link (122), which is translated along the path of the motion transmitting end (114). As shown in FIGS. 4 and 5, as the coupler link (122) is translated, the at least one collapsible union (126) collapses, causing the mating edges of the coupler link (122) and the output link (124) to translate normal to the plane of formation. As the coupler link (122) and the output link (124) translate normal to the plane of formation, the output link is also constrained by the fixed coupling formed at a non-translating end.

The combination of the planar bi-stable compliant component (110) and the spherical mechanism portion (120) result in the present exemplary spherical bi-stable mechanism (100). The present exemplary spherical bi-stable mechanism (100) avoids the difficulty in achieving a stable out-of-plane position for a compliant mechanism by keeping the motion of the planar bi-stable compliant component (110) planar. The out-of-plane motion is achieved by virtue of the spherical mechanism portion's (120) ability to transform an in-plane rotation into an out-of-plane rotation. Out-of-plane rotation may be useful in a number of applications including, but in no way limited to, optical switching by attaching a reflective surface (106) to the spherical mechanism portion (120).

The following describes the geometry of the present exemplary spherical bi-stable mechanism (100) and provides equations for obtaining motion and performance characteristics. Analysis of the present exemplary spherical bi-stable mechanism (100) entails background into two different specialties, compliant mechanisms and spherical trigonometry.

Compliant Mechanisms

Compliant mechanisms, as defined above, are mechanisms that gain some or all of their motion from the deflection of flexible members. Flexible members are advantageous in that their motion is precise and that they can store energy. However, the analysis of compliant mechanisms is, in general, more complex than the analysis of rigid-link mechanisms.

For example, the position analysis of a rigid-link mechanism may be performed using algebraic equations, while the complete position analysis (in which the location of every point in the segment is specified) of a compliant mechanism involves differential equations. However, according to one exemplary embodiment, the complete analysis of compliant mechanisms is not always required. An approximation technique commonly referred to as the Pseudo-Rigid-Body Model (PRBM) allows the determination of the relative positions of the endpoints of various compliant segments without precise modeling of the location of interior points. PRBMs also allow the computation of the amount of force required to produce the desired deflections. The idea of a PRBM is to model the compliant segment with rigid links and joints in a way that closely approximates the motion of the compliant segment. Two PRBMs that are pertinent to the motion of the Young Mechanism are the cantilever beam with a force at the free end, and the small-length flexural pivot.

In these two PRBMs, the flexible segment is modeled by placing a revolute joint, the characteristic pivot, at a specified distance, the characteristic radius, from the free end. The bending of the segment is modeled by the rotation, $\Theta$, of the characteristic pivot. The resistance of the flexible segment to bending is modeled with a torsional spring at the characteristic pivot with a stiffness, K. As the segment bends, the position of the beam end is specified by the coordinates (a, b), where a is the coordinate along the direction of the undetected segment, and b is the coordinate in the direction perpendicular to the undetected segment.

Figure 6:
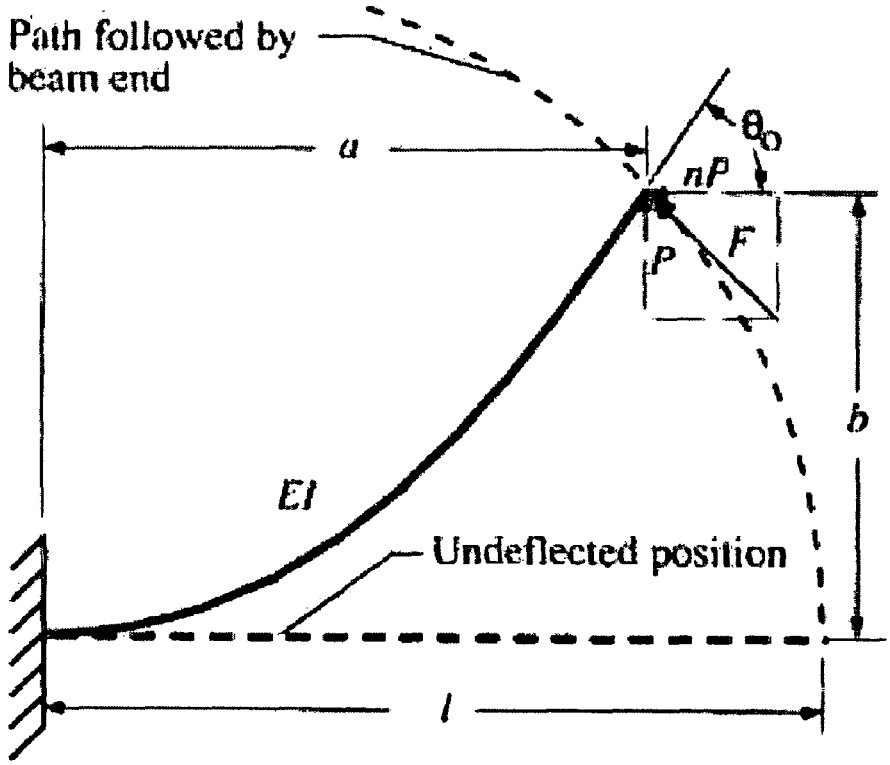
FIG. 6 shows a schematic of a cantilever beam with a force at the free end, F, and its pseudo-rigid-body model, according to one exemplary embodiment.

FIG. 6 shows a schematic of a cantilever beam with a force at the free end, F, and its pseudo-rigid-body model. The model parameters are:

$$a = l[1 - \gamma(1 - \cos\Theta)]$$

$$b = \gamma l \sin\Theta$$

$$K = \gamma K_\theta \frac{EI}{l}$$

$$\gamma \approx 0.85$$

$$K_\theta \approx \pi\gamma$$

The approximate values given for $\gamma$, $c_\theta$ and $K_\theta$ are most appropriate when the applied force is perpendicular to the undetected segment. More accurate approximations are given in [103] for other loading conditions. The maximum stress in the segment occurs at the fixed end and is given by formula 1 below $$\sigma_{max} = \pm\frac{(a = nb)}{I} - \frac{nP}{A} \qquad \text{Equation 1}$$

where P is the component of the applied force, F, in the direction perpendicular to the undetected segment, and nP is the component of the applied force in the direction parallel to the undetected segment.

Figure 7:
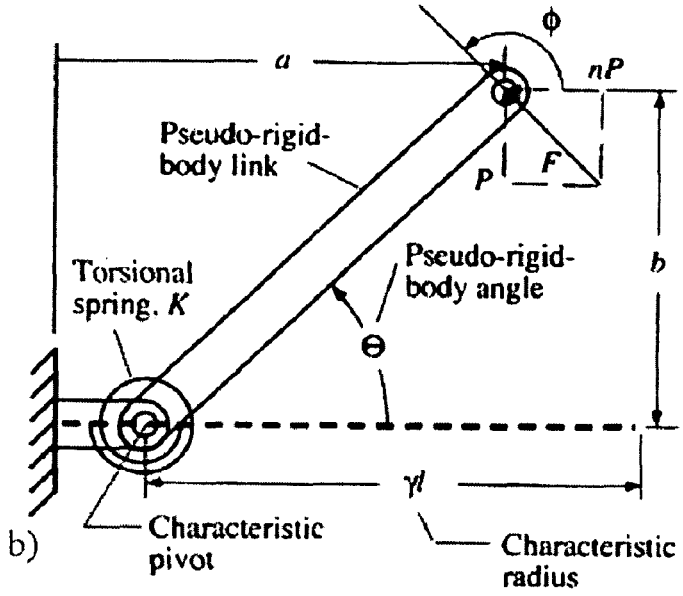
FIG. 7 shows a schematic of a small-length flexural pivot and its pseudo rigid-body model, according to one exemplary embodiment.

FIG. 7 shows a schematic of a small-length flexural pivot and its pseudo-rigid-body model. The small-length flexural pivot is a flexible segment which is small in comparison to a rigid segment to which it is attached such that $l \ll L$ and $(EI)_l \ll (EI)_L$. The characteristic pivot is located at the center of the flexible beam. The model parameters are:

$$a = \frac{l}{2} + \left(L + \frac{l}{2}\right)\cos\Theta$$

$$b = \left(L + \frac{l}{2}\right)\sin\Theta$$

$$K = \frac{EI}{l}$$

The maximum stress in the small-length flexural pivot occurs at the fixed end and is given by formula 2 below:

$$\sigma_{max} = \frac{Mc}{I} \qquad \text{Equation 2}$$

The maximum strain for both models is related to the maximum stress and is given by $$\epsilon_{max} = \frac{\sigma_{max}}{E} \qquad \text{Equation 3}$$

where E is Young Modulus (or modulus of elasticity).

Figure 8:
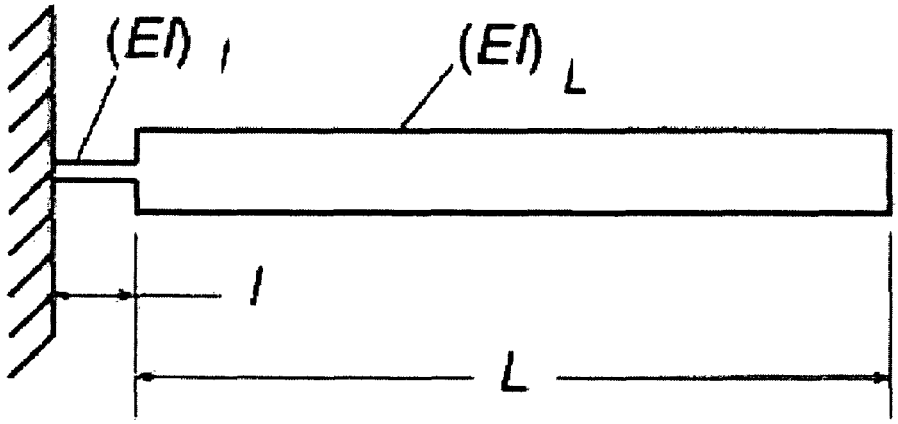
FIG. 8 illustrates a small length flexural pivot, according to one exemplary embodiment.
Figure 9:
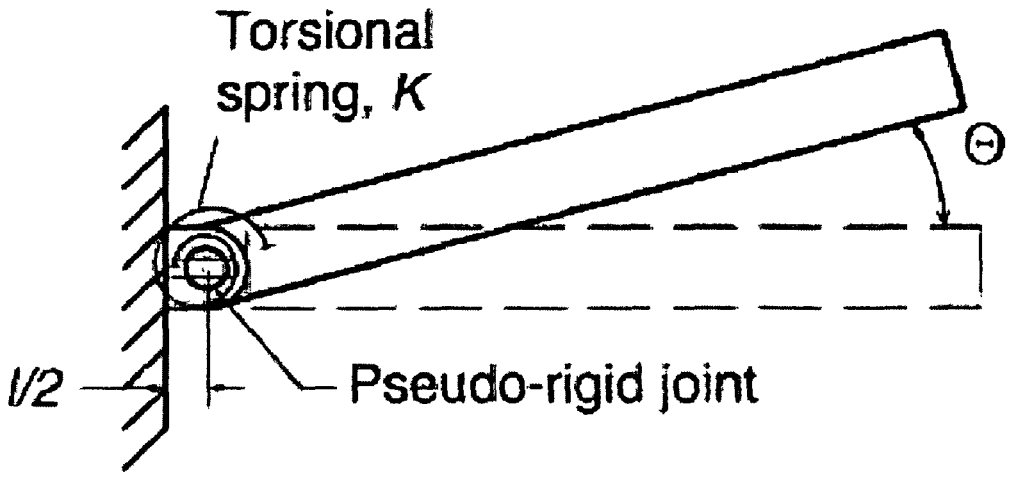
FIG. 9 illustrates a pseudo-rigid-body model equivalent of the small length flexural pivot illustrated in FIG. 8.

These two PRBMs allow the compliant portion of the spherical bi-stable mechanism (100) to be analyzed as a four-bar mechanism with torsional springs on two of the joints as shown in FIG. 8.

Analysis of the spherical slider-crank portion of the spherical bi-stable mechanism (100) requires some background on spherical mechanisms.

Spherical Mechanisms

As used herein, the term "spherical mechanisms" shall be interpreted as including linkages that have the property that every link in the system rotates about the same fixed point. A common method for visualizing the motion of spherical mechanisms is by representing the links in a spherical mechanism as arcs inscribed on a unit sphere. Any two links in a spherical mechanism are joined with a pin (or revolute) joint which permits rotation about an axis in space that passes through the fixed point. In a spherical bi-stable mechanism (100), the fixed point may be either of the bi-stable compliant component's (110) two pin joints (113, 118).

While there are numerous possible approaches for describing the motion of spherical mechanisms, the present section uses an approach based on spherical geometry. The spherical law of cosines is useful in the position analysis of spherical slider-crank mechanism portion (120) of the spherical bi-stable mechanism (100). The background given on compliant mechanisms and spherical mechanisms allows for the position and energy analysis of the spherical bi-stable mechanism (100).

Figure 10:
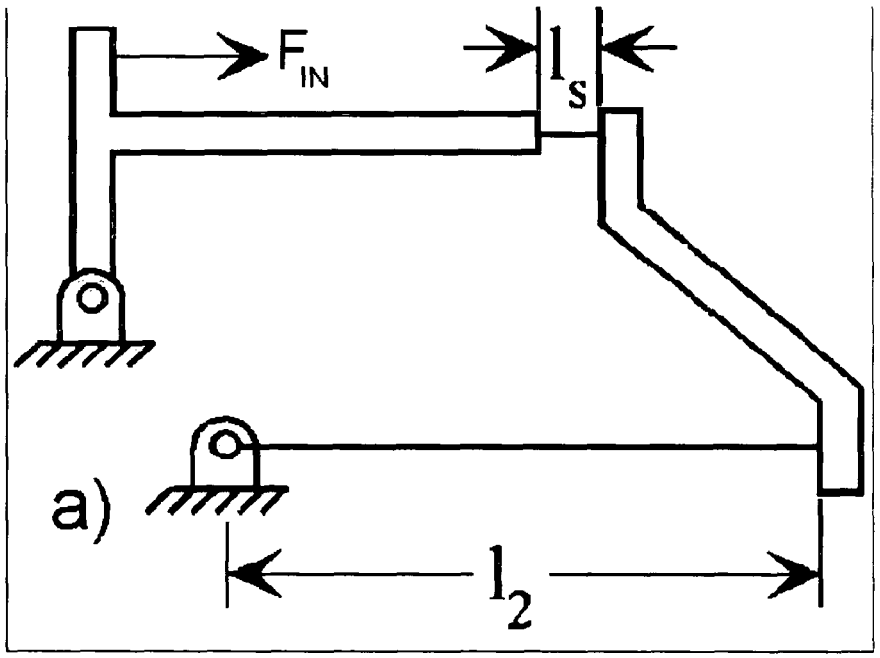
FIG. 10 is a side view of a planar bi-stable component, according to one exemplary embodiment.
Figure 11:
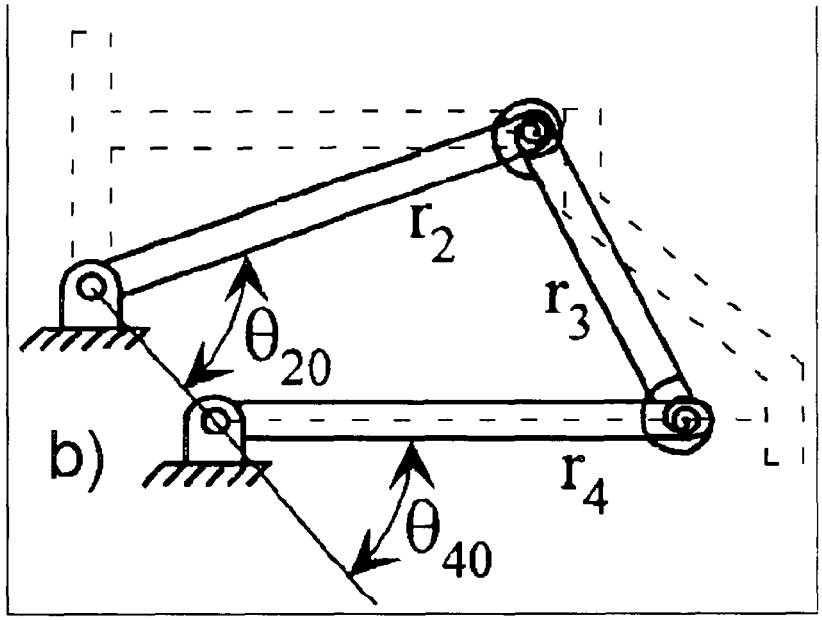
FIG. 11 is a side view of a four-bar apparatus with two torsional springs used to represent the first planar bi-stable component, according to one exemplary embodiment.
Figure 12:
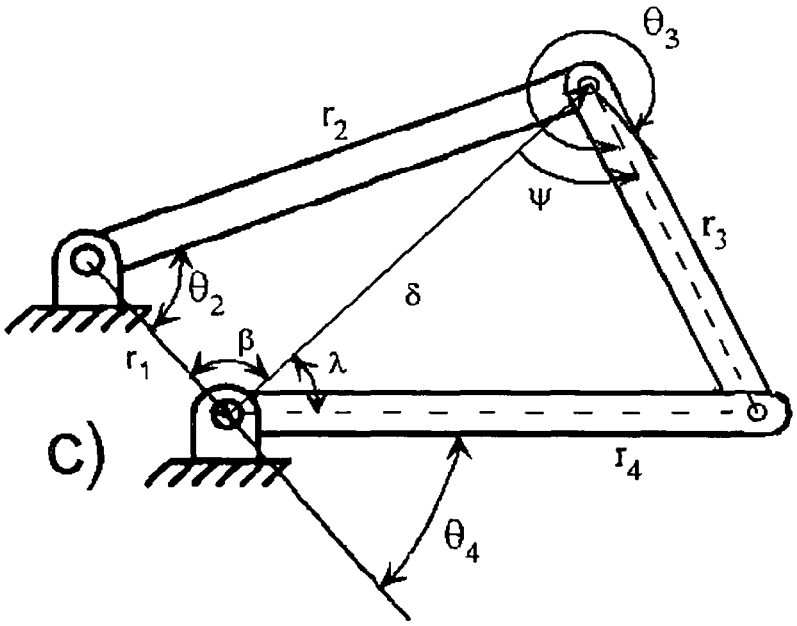
FIG. 12 is a side view of a four-bar apparatus with two torsional springs used to represent the first planar bi-stable component, according to one exemplary embodiment.
Figure 13:
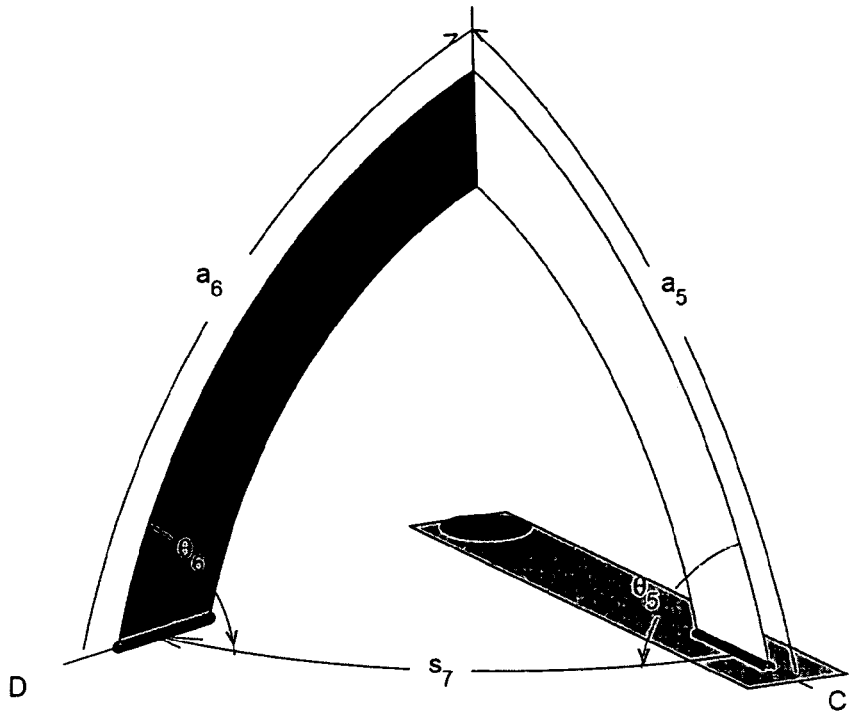
FIGS. 13 is a perspective view of a structural representation of a spherical mechanism portion, according to one exemplary embodiment.

The position analysis of the spherical bi-stable mechanism (100) is divided into two parts, the bi-stable compliant component (110) portion and the spherical slider-crank mechanism portion (120). The bi-stable compliant component (100) portion of the spherical bi-stable mechanism (100) can be analyzed using the PRBM as a four-bar with two torsional springs, as is shown in FIGS. 10 through 12. The analysis of a four-bar mechanism is generally known and may be derived using the law of cosines from planar trigonometry using the angles labeled in FIG. 12.

$$\delta = \sqrt{r_1^2 + r_2^2 - 2r_1 r_2 \cos(\pi - \theta_2)} \qquad \text{Equation 4}$$

$$\beta = \cos^{-1}\left(\frac{r_1^2 = \delta^2 - r_2^2}{2r_1\delta}\right) \qquad \text{Equation 5}$$

$$\psi = \cos^{-1}\left(\frac{r_3^2 + \delta^r - r_4^2}{2r_3\delta}\right) \qquad \text{Equation 6}$$

$$\lambda = \cos^{-1}\left(\frac{r_4^2 + \delta^2 - r_3^2}{2r_4\delta}\right) \qquad \text{Equation 7}$$

For $0 \leqq \theta_2 \leqq \pi$, $\theta_3$ and $\theta_4$ are given by $$\theta_3 = \beta + \pi - \psi \qquad \text{Equation 8}$$

$$\theta_4 = \beta + \pi - \lambda \qquad \text{Equation 9}$$

and for $\pi \leqq \theta_2 \leqq 2\pi$, $\theta_3$ and $\theta_4$ are given by $$\theta_3 = -\beta + \pi - \psi \qquad \text{Equation 10}$$

$$\theta_4 = -\beta + \pi + \lambda \qquad \text{Equation 11}$$

Figure 14:
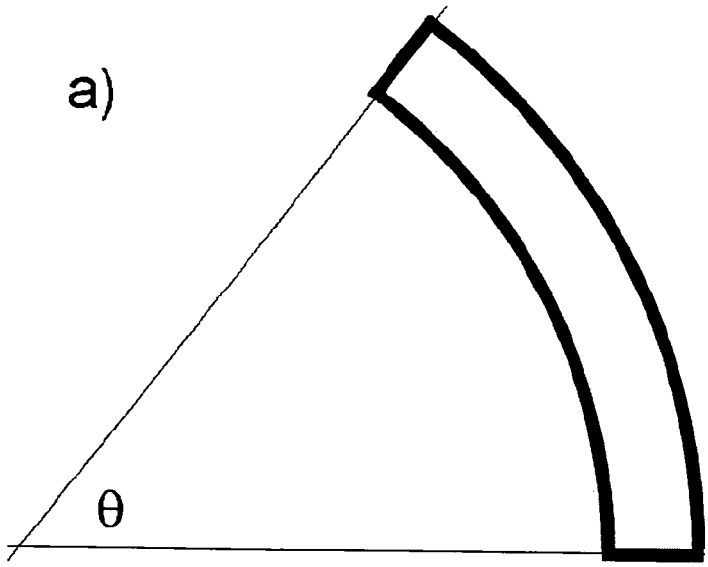
FIGS. 14 and 15 illustrate kinematically identical spherical links, according to one exemplary embodiment.

The orientations $\theta_5$ and $\theta_6$ of links $a_5$ and $a_6$ in the spherical slider-crank portion of the mechanism can be determined based on the spherical triangle formed by links $a_5$, $a_6$, and the arc length $s_7$ between the fixed pivot D and the rotational slider C as shown in FIG. 14. In the fabricated position of the spherical bi-stable mechanism (100), the arc length of $\widehat{DC}$ is given by $$s_{7_0} = a_5 + a_6 \qquad \text{Equation 12}$$

The change in $\widehat{DC}$ as the input link $r_2$ rotates is $\Delta S_7$ and is equal to $\Delta\theta_2=\theta_{20}-\theta_2$, where $\theta_{20}$ is the original orientation of the pseudo link labeled $r_2$ in FIG. 12. Thus, the arc length of $\widehat{DC}$ can be expressed as $$S_7=a_5+a_6-\Delta S_7=a_5+a_6+\theta_2-\theta_{20} \quad \text{Equation 13}$$

Using the spherical law of cosines, expressions using $\theta_5$ and $\theta_6$ can be found. An expression which $\theta_5$ is the only unknown is given by $$\cos(a_6)=\cos(a_5)\cos(S_7)+\sin(a_5)\sin(S_7)\cos(\theta_5) \quad \text{Equation 14}$$

which can be solved for $\theta_5$ as $$\theta_5=\cos^{-1}\left(\frac{\cos(a_6)-\cos(a_5)\cos(S_7)}{\sin(a_5)\sin(S_7)}\right) \quad \text{Equation 15}$$

An expression in which $\theta_6$ is the only unknown is given by $$\cos(a_5)=\cos(a_6)\cos(S_7)+\sin(a_6)\sin(S_7)\cos(\theta_6) \quad \text{Equation 16}$$

which can be solved for $\theta_6$ as $$\theta_6=\cos^{-1}\left(\frac{\cos(a_5)-\cos(a_6)\cos(S_7)}{\sin(a_6)\sin(S_7)}\right) \quad \text{Equation 17}$$

Substituting equation (13) into equation (17) gives the angle of the spherical mechanism output, $\theta_6$, in terms of the bi-stable compliant component (110) input, $\theta_2$.

Figure 15:
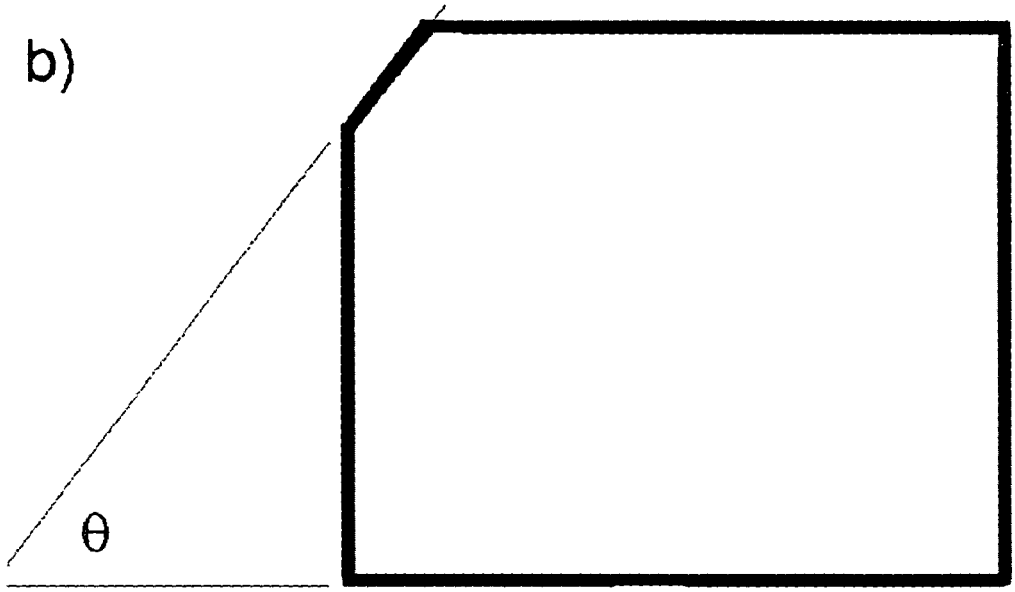
Figure 16:
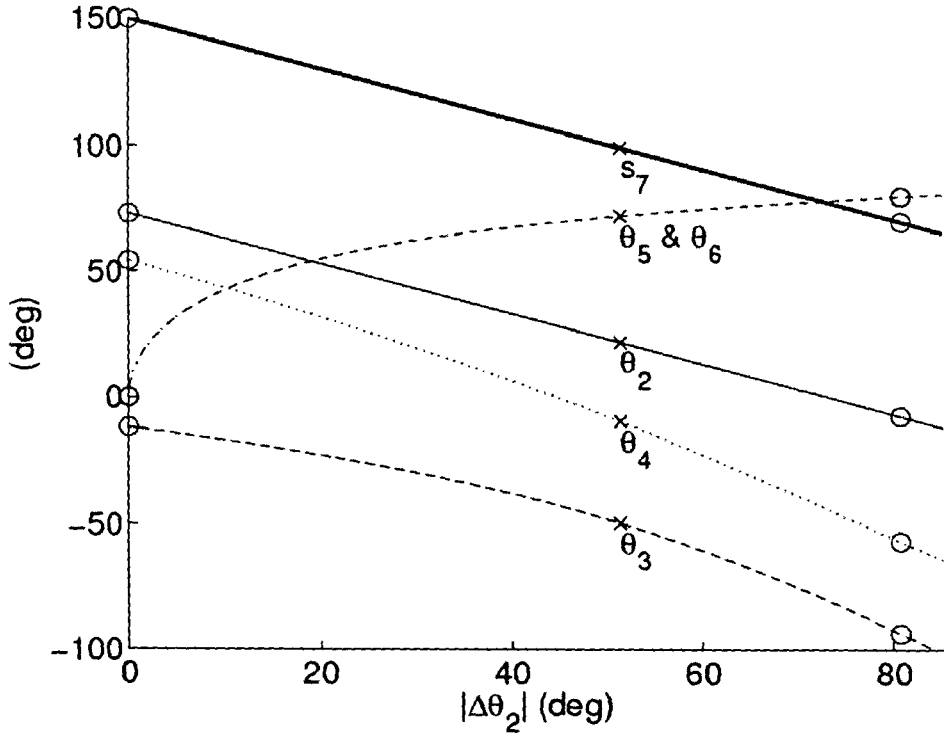
FIG. 16 illustrates a series of plots of the rotation parameters of the mechanism, $\theta_2$, $\theta_3$, $\theta_4$, $\theta_5$, $\theta_6$, and $S_7$ as functions of the magnitude of the change in the input angle $|\Delta\theta_2|$, according to one exemplary embodiment.

The motion of the spherical slider-crank output link depends on the distance and angle between its joints but not on its shape. Thus, both of the links shown in FIGS. 14 and 15 can be modeled by the forgoing equations and the output link can take a shape that is most suited to a given application.

The input force is applied on link $r_2$ as shown in FIG. 10. The potential energy, W, stored in the flexible segments of the spherical bi-stable mechanism (100) can be estimated as a function of $\theta_2$ using the pseudo-rigid body model as $$W(\theta_2)=\frac{1}{2}(K_A\psi_A^2+K_B\psi_B^2) \quad \text{Equation 18}$$

where $\psi_A$ and $\psi_B$ are defined by $$\psi_A=(\theta_2-\theta_{20})-(\theta_3-\theta_{30}) \quad \text{Equation 19}$$

and $$\psi_B=(\theta_4-\theta_{40})-(\theta_3-\theta_{30}) \quad \text{Equation 20}$$

where the spring constants $K_A$ and $K_B$ are calculated using the PRBM, as $$K_A=\frac{EI}{l_s} \quad \text{Equation 21}$$

$$K_B=2.25\frac{EI}{l_4} \quad \text{Equation 22}$$

The values of $\theta_2$ for which the potential energy, W, is a local minimum are the stable equilibrium points for the mechanism. In between the two local minima there is a local maximum, which is the unstable equilibrium point. The input torque, $T_{in}$ required to actuate the mechanism can be found as the derivative of the potential energy with respect to $\theta_2$, or $$T_{in}=\frac{dW}{d\theta_2}=K_A\psi_A(1-h_{32})+K_B\psi_B(h_{42}-h_{32}) \quad \text{Equation 23}$$

where $h_{32}$ and $h_{42}$ are kinematic coefficients $$h_{32}=\frac{d\theta_3}{d\theta_2}=\frac{r_2\sin(\theta_4-\theta_2)}{r_3\sin(\theta_3-\theta_4)} \quad \text{Equation 24}$$

$$h_{42}=\frac{d\theta_4}{d\theta_2}=\frac{r_2\sin(\theta_3-\theta_2)}{r_4\sin(\theta_4-\theta_3)} \quad \text{Equation 25}$$

The joints in the spherical slider-crank are not compliant and so do not enter into the calculation of potential energy. On the other hand, because the spherical slider-crank has a poor transmission angle (≈180°) in the fabricated position, the spherical bi-stable mechanism (100) mechanism can be more difficult to actuate than a bi-stable compliant component (110) alone. It may be helpful to include an auxiliary actuation method to insure that the links in the spherical crank-slider portion of the mechanism lift from the substrate.

Figure 17:
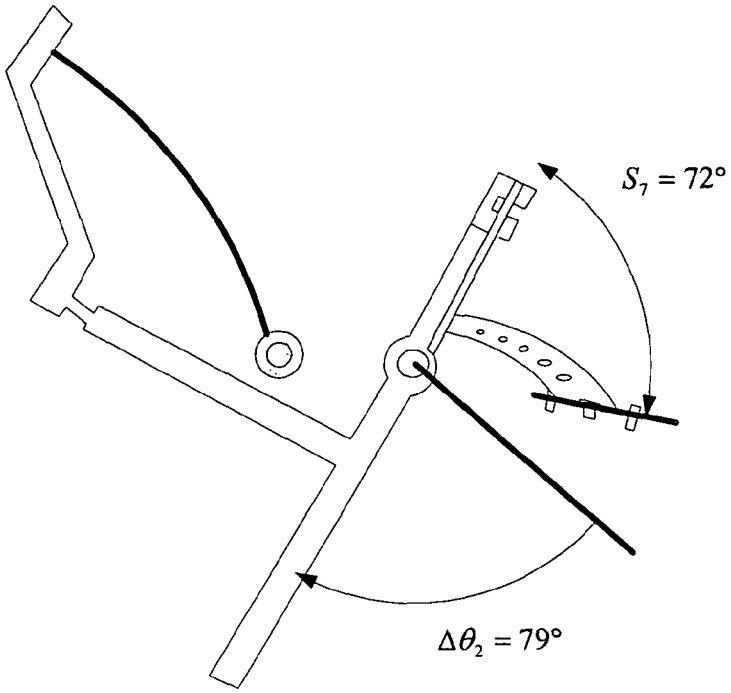
FIG. 17 illustrates a spherical bistable mechanism illustrating various component angles, according to one exemplary embodiment.

A polysilicon E≈169 MPa prototype mechanism having the dimensions illustrated in the structure of FIG. 17 was fabricated using the multi-user MEMS processing system (MUMPS) process and has the dimensions of $r_1$=100 μm, $r_2$=250 μm, $r_3$=176 μm, $r_1$=250 μm. The original orientations of links 2 and 4 are $\theta_{20}$=73° and $\theta_{40}$=53°. The lengths of the compliant segments, $l_s$ and $l_4$, are 30 μm and 295 μm, respectively. The bending moments of inertia for the compliant segments are $I_2=I_4=3.3\ (\mu m)^4$. The spherical mechanism links have a radius of 140 μm and arc lengths $a_5=a_6=75°$. Because links $a_5$ and $a_6$ have the same nominal arc length, the spherical triangle is isosceles and angles $a_5$ and $a_6$ are equal.

FIG. 17 illustrates a series of plots of the rotation parameters of the mechanism, $\theta_2$, $\theta_3$, $\theta_4$, $\theta_5$, $\theta_6$, and $S_7$ as functions of the magnitude of the change in the input angle $|\Delta\theta_2|$. The stable equilibrium positions of the mechanism are marked with 'o's and the unstable equilibrium position of the mechanism is marked with an 'x'. Note that most of the rotation of links $a_6$ and $a_5$ occurs within the first 30 degrees of rotation of $\theta_2$. This implies that the ratio of output motion, $\theta_6$, to input motion, $\theta_2$ is much smaller near the second equilibrium position than it is near the first equilibrium position. This results in finer control of the output motion near the second equilibrium position and it is possible to design for a precise orientation of link 6 in the second equilibrium position.

FIG. 17 shows angular measurements from the second stable position. The motion of the input link, $\Delta\theta_2$ was measured as 79° and the motion and $S_7$ was measured as 72°. These values compare well with the predicted values of $\Delta\theta_2$=80.6° and $S_7$=69.34°. Precise measurements were not available for the out-of-plane rotation and pseudo-link rotation variables. However, in FIG. 17, the link $a_5$ appears to be slightly less than vertical which agrees well with the predicted value of 79.3° for $\theta_5$.

Figure 18:
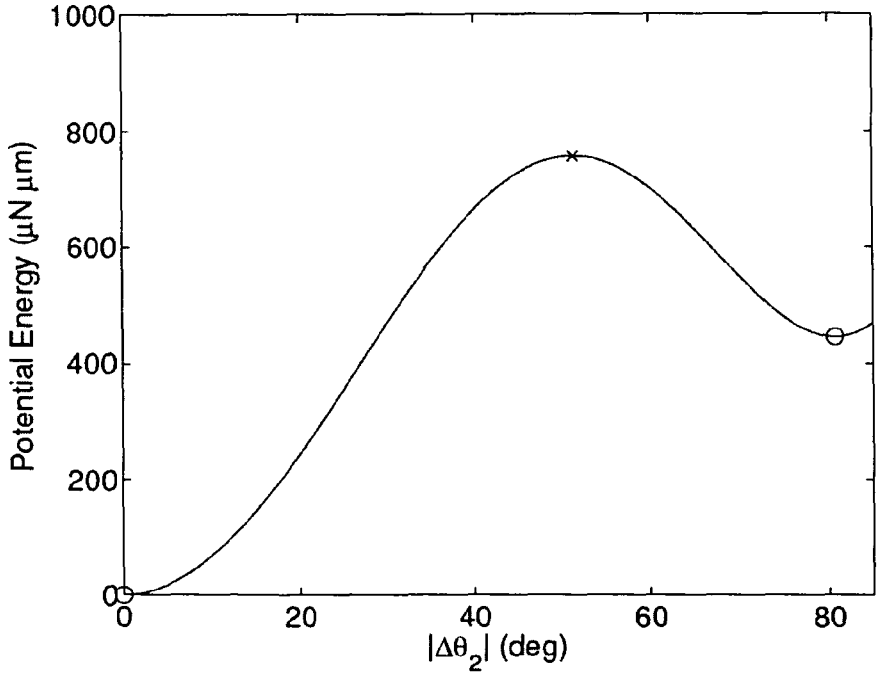
FIG. 18 shows the potential energy curve for a silicon prototype configured according to the dimensions of FIG. 17.
Figure 19:
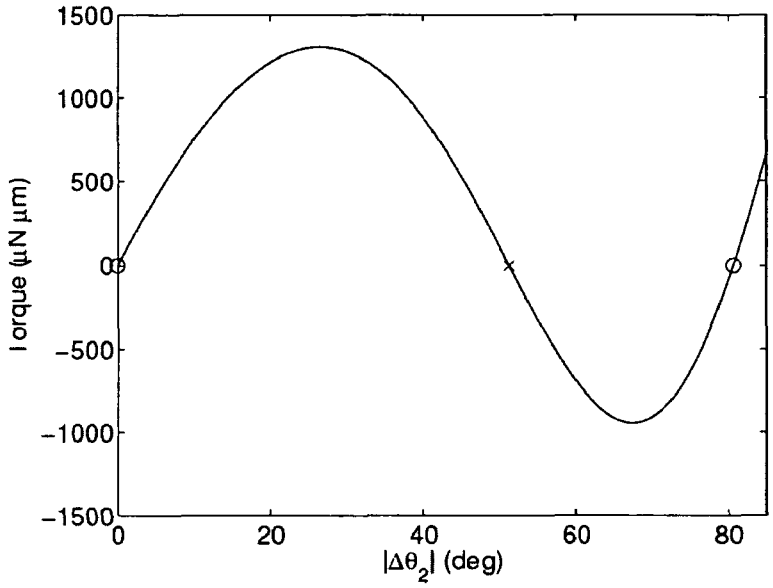
FIG. 19 shows the input torque required to actuate a silicon prototype configured according to the dimentions of FIG. 17.

FIG. 18 shows the potential energy curve for the silicon prototype and FIG. 19 shows the input torque required to actuate the device. Note that the input torque curve (FIG. 19) is the derivative of the potential energy curve (FIG. 18).

Figure 20:
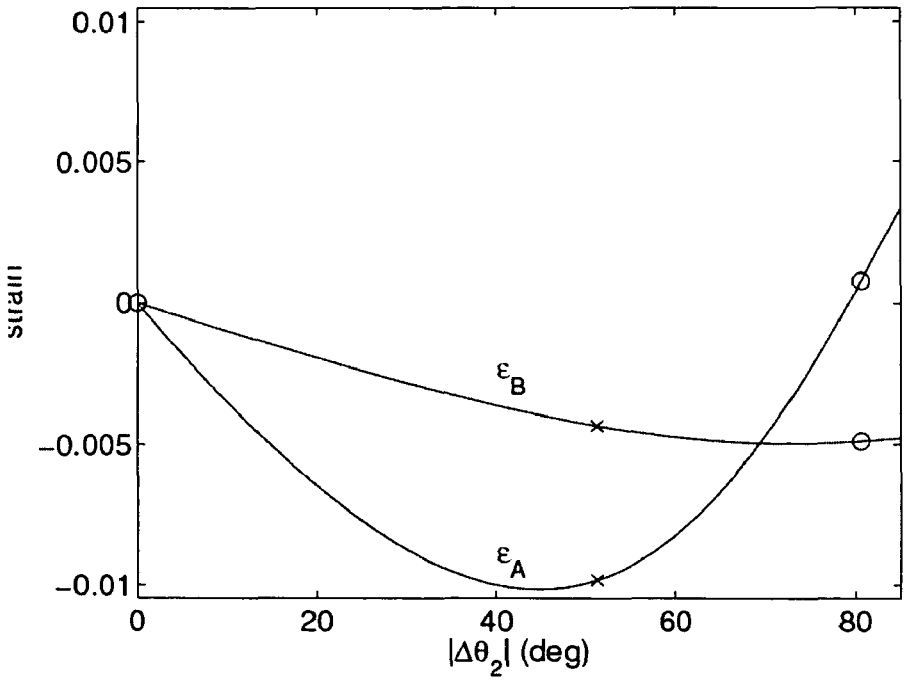
FIG. 20 shows the calculated strain in the flexures of the spherical bi-stable mechanism illustrated in FIG. 17.

FIG. 20 shows the calculated strain in the flexures of the spherical bi-stable mechanism illustrated in FIG. 17. According to one exemplary embodiment, a design goal is to maintain the strain magnitude below $1.05\times10^{-2}$ to avoid fracture.

The present disclosure has detailed the design of a novel device for the bi-stable positioning of an out-of-plane link, such as a micro-mirror. The combination of bistability with spherical mechanism design results in several advantageous features, which include: two stable positions that require power only in transitioning from one position to the other, robustness against small disturbances, and an output link with a stable out-of-plane orientation that can be achieved with great precision. The equations for position, potential energy, input torque and maximum stress have been presented.

The preceding description has been presented only to illustrate and describe embodiments of invention. It is not intended to be exhaustive or to limit the invention to any precise form disclosed. Many modifications and variations are possible in light of the above teaching. It is intended that the scope of the invention be defined by the following claims.

What is claimed is:

1. A spherical bistable mechanism, comprising:

a planar bistable compliant member including an input and an output; and a spherical mechanism member coupled to said output of said first planar bi-stable compliant component;

wherein an actuation of said first planar bi-stable compliant member in a first plane is configured to cause said spherical mechanism member to be selectively positioned in a second plane.

2. The spherical bistable mechanism of claim 1, in which said planar bi-stable compliant member comprises:

a four bar structure;

wherein said four bar structure includes a first and a second rigid member and a first and a second compliant member.

3. The spherical bistable mechanism of claim 2, wherein said planar bi-stable compliant member further comprises:

a first pin location disposed on said first rigid member; and a second pin location disposed on said second rigid member;

wherein said input and said output are disposed on said first rigid member.

4. The spherical bistable mechanism of claim 2, wherein said planar bi-stable compliant member comprises a Young Mechanism.

5. The spherical bistable mechanism of claim 1, wherein said mechanism further comprises a microelectromechanical system (MEMS).

6. The spherical bistable mechanism of claim 1, wherein said spherical mechanism member comprises a spherical slider crank.

7. The spherical bistable mechanism of claim 6, wherein said spherical slider crank comprises:

a coupler link member coupled to said output of said planar bistable compliant member;

an output link having a first and a second end;

wherein said first end of said output link is coupled to said coupler link by a collapsible union; and wherein said second end of said output link is hingedly coupled to a base substrate.

8. The spherical bistable mechanism of claim 7, wherein said collapsible union comprises a compliant torsional hinge.

9. The spherical bistable mechanism of claim 7, wherein said second end of said output link is hingedly coupled to said base substrate by a compliant torsional hinge.

10. The spherical bistable mechanism of claim 1, further comprising a reflective surface coupled to said spherical mechanism member.

11. The spherical bistable mechanism of claim 10, wherein said spherical bistable mechanism is configured to function as an optical switch.

12. The spherical bistable mechanism of claim 1, wherein said planar bistable compliant member and said spherical mechanism member are fabricated in a single plane.

13. The spherical bistable mechanism of claim 12, wherein said spherical bistable mechanism is formed by a multi-user MEMS processing system.

14. A microelectromechanical system (MEMS) spherical bistable mechanism, comprising:

a four bar planar bistable compliant member including an input and an output, wherein said four bar bistable compliant member includes a first and a second rigid member and a first and a second compliant member; and a spherical mechanism member coupled to said output of said first planar bi-stable compliant component;

wherein an actuation of said first planar bi-stable compliant member in a first plane is configured to cause said spherical mechanism member to be selectively positioned in a second plane.

15. The MEMS spherical bistable mechanism of claim 14, wherein said planar bi-stable compliant member further comprises:

a first pin location disposed on said first rigid member; and a second pin location disposed on said second rigid member; wherein said input and said output are disposed on said first rigid member.

16. The MEMS spherical bistable mechanism of claim 15, wherein said planar bi-stable compliant member comprises a Young Mechanism.

17. The MEMS spherical bistable mechanism of claim 14, wherein said spherical slider crank comprises:

a coupler link member coupled to said output of said planar bistable compliant member;

an output link having a first and a second end;

wherein said first end of said output link is coupled to said coupler link by a collapsible union; and wherein said second end of said output link is hingedly coupled to a base substrate.

18. The MEMS spherical bistable mechanism of claim 17, wherein said collapsible union comprises a compliant torsional hinge.

19. The MEMS spherical bistable mechanism of claim 17, wherein said second end of said output link is hingedly coupled to said base substrate by a compliant torsional hinge.

20. The spherical bistable mechanism of claim 14, further comprising a reflective surface coupled to said spherical mechanism member.

21. The spherical bistable mechanism of claim 14, wherein said planar bistable compliant member and said spherical mechanism member are fabricated in a single plane.

22. A method of designing a microelectromechanical system (MEMS) spherical bistable mechanism that includes a four bar planar bistable compliant member and a spherical mechanism member, comprising:

performing a position analysis of four bar planar bistable compliant member using a Pseudo-Rigid-Body Model (PRBM) approximation; and executing a position analysis of the spherical bi-stable mechanism using spherical geometry and a position input from said position analysis of said four bar planar bistable compliant member.

* * * * *